US011148872B2

(12) United States Patent
Bürkle

(10) Patent No.: US 11,148,872 B2
(45) Date of Patent: Oct. 19, 2021

(54) TWO-COMPONENT PRESSURIZED CAN

(71) Applicant: SIKA TECHNOLOGY AG, Baar (CH)

(72) Inventor: Jochen Bürkle, Steinheim an der Murr (DE)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 16/767,485

(22) PCT Filed: Nov. 27, 2018

(86) PCT No.: PCT/EP2018/082639

§ 371 (c)(1),
(2) Date: May 27, 2020

(87) PCT Pub. No.: WO2019/102026

PCT Pub. Date: May 31, 2019

(65) Prior Publication Data

US 2021/0002063 A1 Jan. 7, 2021

(30) Foreign Application Priority Data

Nov. 27, 2017 (DE) ..... 102017127915.6

(51) Int. Cl.
*B65D 83/66* (2006.01)
*B65D 83/68* (2006.01)

(52) U.S. Cl.
CPC ..... *B65D 83/666* (2013.01); *B65D 83/687* (2013.01)

(58) Field of Classification Search
CPC ..... B65D 81/325; B65D 81/3222; B65D 83/666; B65D 83/687
USPC ..... 222/145.4, 130, 635, 402.1
See application file for complete search history.

(56) References Cited

U.S. PATENT DOCUMENTS 3,437,242 A * 4/1969 Poitras ..... B65D 81/3255 222/135
3,727,797 A 4/1973 Cronan
4,651,899 A * 3/1987 Pauls ..... B65D 81/32 222/130

(Continued)

FOREIGN PATENT DOCUMENTS

WO 85/00157 A1 1/1985
WO 2004/056660 A2 7/2004

(Continued)

OTHER PUBLICATIONS

Feb. 18, 2019 International Search Report issued in International Patent Application No. PCT/EP2018/082639.

*Primary Examiner* — Vishal Pancholi
(74) *Attorney, Agent, or Firm* — Oliff PLC

(57) ABSTRACT

A two-component pressurized can having a body, a dome, a valve arranged in the dome, an inwardly curved bottom and an opening device which is arranged in the bottom and can be actuated through the bottom from the outside, in which the can body has a peripheral necking to which there is secured a separating disk which divides the can into a lower chamber and an upper chamber, wherein the separating disk has a central opening which is closed by a closure element, and wherein the opening device can be moved against the closure element via the triggering member in order to detach the closure element from the separating disk.

17 Claims, 5 Drawing Sheets

(56) References Cited

U.S. PATENT DOCUMENTS

| | | | | | |
|---|---|---|---|---|---|
| 4,749,105 | A * | 6/1988 | Derksen | B65D 83/0022 | 222/80 |
| 5,082,146 | A * | 1/1992 | Hardt | B65D 83/687 | 222/135 |
| 5,215,225 | A * | 6/1993 | Kopp | B65D 81/3222 | 206/219 |
| 5,573,137 | A * | 11/1996 | Pauls | B65D 83/64 | 222/129 |
| 7,455,195 | B2 * | 11/2008 | Mekata | B65D 83/40 | 222/94 |
| 8,025,168 | B2 * | 9/2011 | Bullard | A61J 9/00 | 215/11.1 |
| 8,672,186 | B2 * | 3/2014 | Geiberger | B05B 11/00416 | 222/135 |
| 2007/0251954 | A1 * | 11/2007 | Fazekas | B65D 83/687 | 222/135 |

FOREIGN PATENT DOCUMENTS

| | | | |
|---|---|---|---|
| WO | 2005/000518 | A2 | 1/2005 |
| WO | 2006/069458 | A1 | 7/2006 |
| WO | 2008/092670 | A1 | 8/2008 |

* cited by examiner

TWO-COMPONENT PRESSURIZED CAN

The invention relates to a two-component pressurized can having a body, a dome, a valve arranged in the dome, an inwardly curved bottom and an opening device which is arranged in the bottom and can be actuated through the bottom from outside. The pressurized can is particularly intended for storing and dispensing two-component systems, for example assembly foams having a joining agent component and/or filler component.

The invention relates to the formation of pressurized cans which, in addition to the substances of the main component, receive a second component which reacts with the main component to form the finished product, a multi-component system. Such systems are particularly used in assembly and insulation technology, for example for foaming in door and window frames, for foaming shut wall breaches and gaps, for sound and heat insulation and also for the production of foams which are given fire-retarding properties by virtue of is mineral additives. It is equally possible for such two-component systems to be used for the production of two-component coatings and two-component adhesives.

The substances of the main component that are contained in the pressurized container are liquid and comprise, in the case of an assembly foam, for example a polyurethane prepolymer having terminal reactive isocyanate groups. Further customary substances are generally present. The main component further contains a liquid gas component which serves to drive out and foam the can contents. The liquid gas component simultaneously serves as a solvent.

The second component contains, in the case of an assembly foam, in addition to other components, a crosslinker which is capable of reacting with the reactive isocyanate groups of the main component. This is generally a substance having reactive hydrogen atoms, for example water or a polyol. The reaction with the main component proceeds directly after combining the components, with the result that the dispensing of the mixture must begin directly after the two components have been mixed. The reaction and the foaming with the aid of the propellant gas lead to the formation of the more or less rigid assembly foam at the site of use.

As a rule, the second component of a two-component pressurized can is held available in a separate sleeve which is arranged on the bottom of the pressurized can and can be activated through the bottom by means of a triggering mechanism. This occurs for example by virtue of a plunger which projects into the inner sleeve from outside and is displaced by pressing in against the cover of the inner sleeve and ejects this cover. Subsequently thereto, the contents of the inner sleeve can be mixed with the can contents by shaking, and the then already reacting product mixture can be dispensed. Reference is made by way of example to WO 85/00157 A.

These inner sleeves have fundamentally proven to be very acceptable, but have the disadvantage that, for a voluminous second component, the inner sleeve offers too little space. This applies particularly when a relatively large amount of a second component, for example a fire retardant contained in a carrier liquid, is intended to be admixed with the main component. Such fire retardants, for instance graphite or hydrated aluminum oxide, have proven to be incompatible with the prepolymer, with the result that they can be admixed with the main component only directly before emptying the pressurized can. As a rule, the second component additionally also contains a crosslinker.

A solution is therefore now sought that allows for even relatively large amounts of a second component to be accommodated in a two-component pressurized can such that the two components are strictly separated from one another during the storage time, but can be brought into connection with one another and thoroughly mixed before emptying the pressurized can.

This is achieved with a two-component pressurized can of the type described at the outset in which the can body has a peripheral necking to which there is secured a separating disk which divides the can into a lower chamber and an upper chamber, wherein the separating disk has a central opening which is closed by a closure element, and wherein the opening device can be moved against the closure element in order to detach the closure element from the separating disk.

The two-component pressurized cans according to the invention are primarily intended for dispensing assembly foams having a joining agent component and/or filler component, wherein the filler component can be a fire retardant, for instance graphite, but also a mineral additive for influencing the foam properties. However, in principle, such two-component pressurized cans are also suitable for two-component coatings, two-component adhesives and other two-component systems which are stored in a pressurized can and dispensed from a pressurized can. Here, the distribution of the two components between the two chambers is arbitrary or follows the respective requirements.

The invention allows for the volumes of the upper and lower space to be tailored to the requirements of the respective application. Thus, for example, is mixing ratios of the first component to the second component of 10:90 to 90:10, according to volume, are readily possible. The requisite adaptation of the pressurized can requires no major technical effort or outlay.

The pressurized can according to the invention has, in a conventional manner, a dome with inserted valve, a body and an inwardly curved bottom which is fitted into the body. The bottom has centrally arranged therein an opening for the opening device which can be actuated from outside via a triggering member. However, by contrast with conventional pressurized cans, the body has a necking which runs around at the same height and which serves as a support and abutment for a separating disk which is fitted in on the inside and which divides the can interior into an upper chamber and a lower chamber. The necking can be arranged at virtually any desired height of the can and thus divide the can interior in a ratio in the range of 10:90 to 90:10, according to volume.

The separating disk, which is arranged to divide the can interior at the level of the necking, has a central opening which is closed by a closure element. This closure element can be opened with the aid of the opening device, wherein the opening device can be actuated through the can bottom by a triggering member. Here, the opening device can be moved vertically by the triggering member, with the result that the closure element can be opened or ejected from the lower chamber into the upper chamber. With the freeing of the opening, the contents of the two can chambers can be mixed and react with one another. It is therefore expedient for the central opening in the separating disk to be kept relatively large, for example with a diameter of ⅓ to ⅙ of the can diameter.

The fact that the separating disk is curved into the upper chamber is of particular importance when the prepolymer component contained in the upper chamber is present under pressure there together with the propellant gas and the second component is pressurelessly filled in the lower chamber. In this case, the curvature stabilizes the separating disk against the pressure which, moreover, is channeled away against the outer wall into the necking.

The separating disk expediently also has, in the region of the central opening, a peripheral edge or collar which, on the one hand, brings about stabilization in is this region and, on the other hand, serves for example to receive a plug and provide the latter with additional retention over the wall surface.

To secure the separating disk to the necking, said disk has a peripherally extending groove in which the necking engages and which interacts with the necking. In the region of this groove there can be arranged a sealing element, for example an O-ring or a sealing strip. However, the system is generally self-sealing since, as a result of reaction, component penetrating into the groove from below and from above reacts to form a polymer and reliably closes any passages.

If pressure differences exist between the upper and the lower chamber, it is expedient to produce the separating disk from a pressure-resistant plastic in order to avoid deformations. Such a pressure-resistant plastic is polyoxymethylene, for example. The separating disk can also consist of metal.

In any case, with some plastics such as polyalkylenes, there occurs over time a gas transfer, and thus a pressure transfer, over the boundary surface, even though the separating disk.

The separating disk can be mounted by means of latching or snapping the bead of the necking into the groove of the separating disk by means of pressure, but also by forming the necking in the region of the groove with the separating disk having been inserted beforehand. The separating disk can also be placed after the lower chamber has been filled.

The necking can have any shape suitable for securing the separating disk, for example a circular or ovally rounded or else stepped shape.

The closure element of the separating disk can be formed in various ways.

On the one hand, there is the possibility of providing a membrane which is integrally formed with the closure element, for example. However, such a membrane can also be applied by adhesive bonding or welding, for example by ultrasonic welding. It goes without saying that the membrane has to be sufficiently pressure-resistant. At the same time, however, it has to either tear open or burst off under the pressure of the opening device. In the case of a closure element formed integrally with the separating disk, it can therefore be expedient to provide predetermined breaking points which tear open under the pressure of the opening device and free the passage opening. Such a predetermined breaking point has, for example, a circular profile along the edge of the membrane.

Alternatively, the central opening of the separating disk can have arranged therein a cap or a cover which are secured in the region of the upper side of the separating disk, for example by means of an edge which extends around the collar of the separating disk and which has a seal running around on the inner side. It is also possible for the cap or cover, which generally have a more stable design than a membrane, to be adhesively bonded to the upper side of the separating disk or to the upper edge of the collar.

Finally, there is the possibility of arranging within the opening a plug which is sealed by an O-ring against the wall of the separating disk in the region of the opening. Such a plug is sealingly fitted into the opening of the separating disk and is secured, on the one hand, by frictional engagement and, on the other hand, by the pressure bearing on it in the upper space.

The pressurized can according to the invention has an opening device which is based on conventional principles, as described, for example, in WO 85/00157 A, WO 2004/056660 A, WO 2008/092670 A or WO 2005/05180 A. Although the opening devices illustrated therein are intended for the opening of inner sleeves, they can equally be applied to the pressurized can subdivided according to the invention.

The opening device accordingly has a plunger which acts against the closure element and tears open or ejects the closure element. In addition, such an opening device expediently has a triggering pin which is resiliently mounted in a spring cage arranged centrally in the bottom, can be actuated from outside by a triggering member and can move the plunger vertically against the closure element. The triggering pin, plunger and spring cage, together with the necessary seals, form the opening device. Here, the spring cage is secured in a plate which is crimped with the bottom in the region of the central opening of is the bottom.

It goes without saying that the triggering pin projects outwardly through the bottom of the pressurized can and interacts there with a triggering member which is suitable for example for pressing in the triggering pin. This can occur for example by virtue of the fact that the pressurized can is forcefully pressed or pushed by its bottom onto a smooth surface, thereby moving the triggering pin against the plunger and the plunger against the closure element.

It may be expedient for the triggering pin, together with the spring cage, to be protected by an adhesively bonded-on membrane or an overcoat which bears tightly against the device and, upon actuation, has to be pierced by the triggering pin. Such a membrane prevents the ingress of material into the spring cage and the blockage of the spring mechanism by said material.

It goes without saying that the spring cage and also the triggering pin have sealing elements which prevent liquid from escaping from the lower space through the bottom opening of the can bottom. In the case of the triggering pin, this is expediently an O-ring which acts against the spring cage, and, in the case of the spring cage, a sealing disk which is placed in the bottom plate and against which the spring cage is braced. In this respect, reference is made to WO 2008/092670 A, already mentioned above.

To secure the triggering pin within the spring cage, it has, in a known manner, a projection which, on the bottom side, acts against the bottom plate and prevents the triggering pin from being pressed out of the can, and, on the valve side, acts on the helical spring arranged above and forms there the abutment for the helical spring.

As an alternative to the above-described opening device with spring cage, triggering pin and plunger, a screw rod also comes into consideration for opening the closure element. Such a screw rod likewise interacts with a triggering member, which is arranged below the can bottom, and projects through the can bottom directly up to the closure element or else indirectly via a triggering pin. The screw rod is screwed into a threaded block either on the bottom side or valve side, with the bottom-side threaded block being secured to the bottom plate of the opening device, and the valve-side threaded block being secured to a plug or cover. Upon rotating the threaded rod with the aid of is a triggering member, the threaded rod is screwed out of the threaded block and as a result the closure element is pressed out of its anchoring. In order to prevent a situation in which the plug or cover corotates with the rotational movement of the threaded rod and a pressing-out operation is prevented as a result, it is expedient for an arresting device to be provided on the closure plate adjoining the inner edge, said arresting device being for example in the form of a peg or pin which interacts with a corresponding notch in the cover edge or plug edge and blocks a rotational movement. In the case of a threaded block which is arranged on the bottom side and which is anchored in the bottom plate, there is no need for blocking; the threaded block is sufficiently protected against rotation by being secured in the bottom plate. In this case, too, measures are required for producing the sealing tightness to the outside, for example by arranging one or more O-rings directly above the passage of the threaded rod through the bottom plate. The threaded block is configured in this case in such a way that the thread does not extend as far as the bottom plate but ends above; the threaded rod and threaded block are provided with a smooth wall above the passage through the bottom plate, with the result that sealing by one or more O-rings, which are guided in grooves, for example, is readily possible.

In the case of a threaded rod, the triggering member is expediently a toggle or ring guided through a transverse bore situated in the end region of the threaded rod outside the can.

The pressurized can according to the invention can be manufactured in a simple manner by introducing the prefabricated separating disk into the cylindrical blank during the production of the aerosol can. The fastening occurs by means of the necking or bead, with the sealing tightness being produced by means of a seal already arranged in the groove. The filling of the lower chamber, possibly also with gas, can occur through the bottom opening before the latter is closed by the bottom plate. As a rule, the lower chamber is not completely filled and is pressureless. The filling of the upper chamber occurs through the valve opening, which is charged with gas through the previously inserted valve. Over time, however, propellant gas also passes from the upper chamber into the lower chamber. However, this is unimportant for the is functioning.

Upon the triggering of the can by actuating the plunger or the screw rod, the separating disk is opened, thereby leading to some of the pressurized content of the upper chamber being pressed into the lower chamber under the action of the propellant gas. There occurs a mixing and additionally an exchange of the contents of the two can chambers, which is also promoted by mixing aids in the form of metal balls or metal rods with shaking. A short time after triggering, the pressurized can is operationally ready for dispensing the foam.

The invention will be explained in more detail by the appended drawings. Identical reference signs designate elements having the same function. In the drawings.

Figure 1:
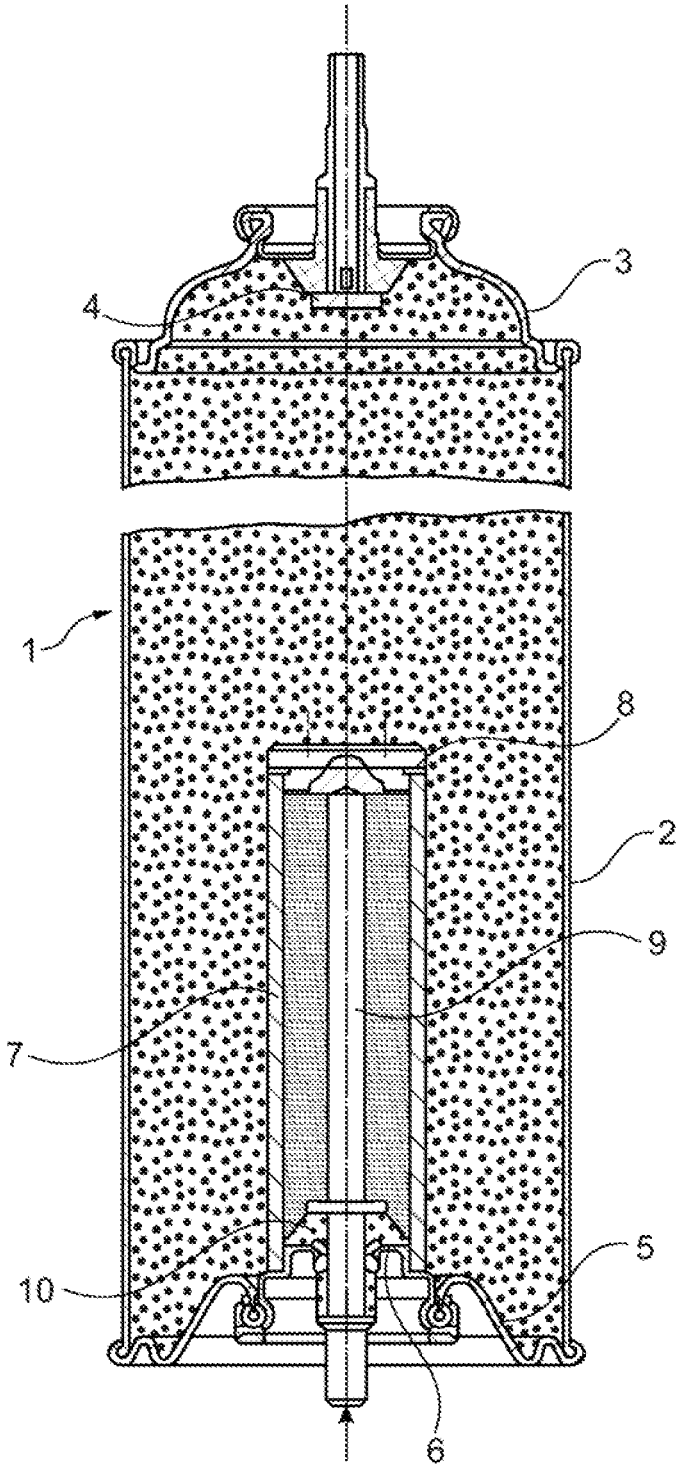
FIG. 1 shows a pressurized can with inner sleeve according to WO 85/00157 A.

FIG. 1 shows a pressurized can according to WO 85/00157 A having a body 2, which is closed at the upper end by a dome 3. The dome 3 has a flanged edge which connects the dome and body to one another and simultaneously produces a sealed connection of the parts. The dome 3 is produced from a round plate and a shaped part which is cut from sheet metal and which has acquired the curved shape visible from the drawing by forming. The inner edge of the dome 3 is for its part flanged and receives a valve disk with a valve 4.

The bottom 5 is likewise connected to the body 2 via a flanged edge and has in is its center a bottom plate 6 above which the inner sleeve 7 is situated. The inner sleeve 7 has a cover 8 which can be ejected. Within the inner sleeve 7 there is situated a plunger 9 whose end is guided out of the pressurized can through a sealing element 10 at the bottom. On both sides of the sealing element 10, the plunger has boundary elements, both of which act against the sealing element 10 and delimit the free displacement length of the plunger 9 within the inner container 7. Ejection of the cover 8 from the inner container 7 occurs by the plunger 9 being pressed in by striking the can bottom onto a firm surface and being moved in an upward motion. The rubber-elastic sealing element 10 absorbs this upward motion and, after the cover 8 has been ejected, returns the plunger 9 into its starting position.

The operating principle of the pressurized can shown in FIG. 1 also applies to the pressurized can according to the invention, with the rubber-elastic sealing element 10 being replaced by a spring cage and the inner sleeve being replaced by the separated-off space below the separating disk. However, in principle, the use of a plunger 9 together with a rubber-elastic sealing element 10 is also possible according to the invention.

Figure 2:
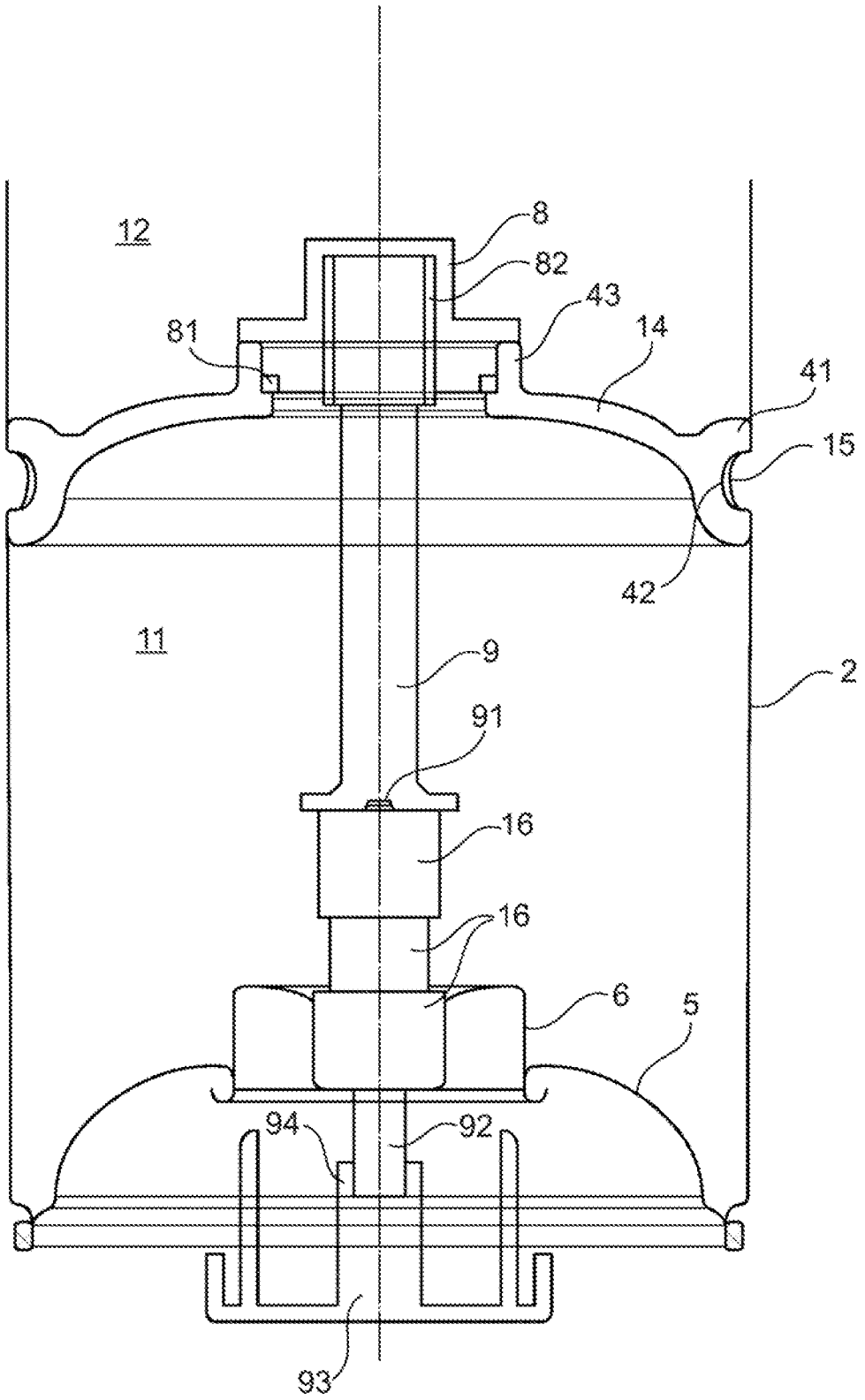
FIG. 2 shows a portion of a pressurized can according to the invention with the relevant features.

FIG. 2 shows the lower part of a pressurized can according to the invention in longitudinal section with the body 2, the bottom 5 and the bottom plate 6. The body 2 has a peripheral necking 15 which serves as retention for the separating disk 14. The separating disk 14 separates the can interior into a lower chamber 11 and an upper chamber 12.

The separating disk 14 is curved into the upper chamber 12. Since the upper chamber 12 generally has a higher pressure than the lower chamber 11, the inward curvature serves to increase the pressure resistance.

The separating disk 14 has in its edge region 41 a thickening into which a groove 42 is incorporated. This groove 42 serves to receive the necking 15, with it being possible for a flat seal or an O-ring (not shown) to be placed between the upper chamber 12 and the lower chamber 11 in order to increase the sealing tightness.

The separating disk 14 has a central opening which is circular as a rule. Along is the opening there is situated a collar 43 which runs around and, on the one hand, serves for reinforcement and stiffening in the region of the opening and, on the other hand, increases the contact area for the plug 8. The plug 8 is fitted into the central opening and, for sealing purposes, has a peripheral O-ring 81 which acts against the inner edge of the separating disk 14.

The plug 8 itself has a central bore or receptacle 82 into which the valve-side end of the plunger 9 projects. The plunger 9 itself is in contact with the triggering pin 91, which is arranged substantially within the spring cage 16 and projects out of the bottom by its bottom-side end 92. A triggering member 93 engages around the bottom-side end 92 of the triggering pin 91 in such a way that, upon forceful striking of the can onto the bottom, the pin is pressed inwardly, and the force is transmitted to the plunger 9, which releases the plug 8 from its retention in the opening of the separating disk 14. The triggering member 93 takes the form of a knob whose receptacle for the end 92 of the triggering pin 91 is dimensioned in such a way that it limits the pressing-in of the triggering pin 91 to a defined length.

The spring cage 16 itself is anchored in the bottom plate 6, with the bottom part 6 being crimped with the can bottom 5 and the can bottom 5 being crimped with the body 2. The spring cage 16 itself is illustrated in one possible variant in FIG. 3.

Figure 3:
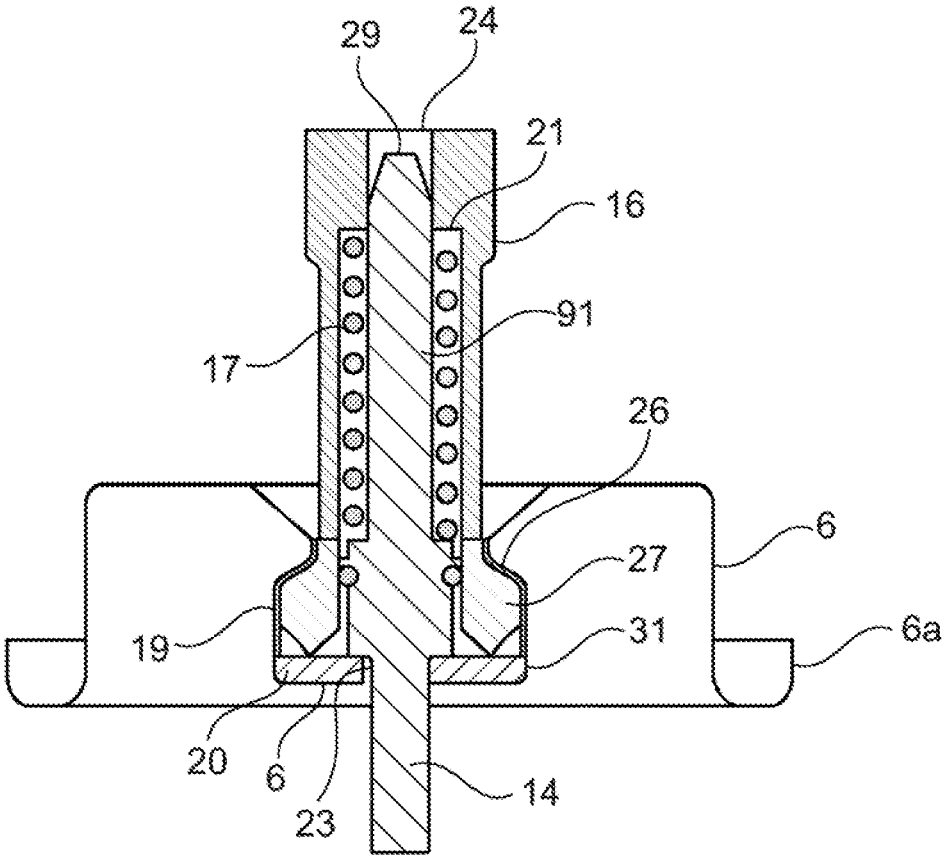
FIG. 3 shows a spring cage as can be used according to the invention.

FIG. 3 shows in detail the bottom plate 6 together with the crimped-in spring cage 16, with spring elements 17 arranged therein and with the triggering pin 91.

The bottom plate 6 has peripherally a crimp projection 6*a* and centrally a formation 19 which is oriented toward the outside of the can and within which the spring cage 16 is crimped in. In this formation 19, which has a central aperture, there is situated a sealing disk 20 against which the bottom-side end 31 of the spring cage 16 acts. The spring cage 16 has, at its valve-side end, a membrane 24 and the projection 21 which runs around on the inside and against which the helical spring 17 acts.

The membrane 24 is adhesively bonded to the spring cage 16. Alternatively, an overcoat can also be stretched over the valve-side end of the spring cage 16.

Within the spring cage 16 and the helical spring 17 there is arranged the triggering pin 91 whose valve-side end 29 is arranged directly below the membrane 24. The helical spring 17 is supported, at its valve-side end, on the projection 21 of the spring cage 16 and, at its bottom-side end, on the projection 22 of the triggering pin 91. Within this projection there is situated the seal 26, an O-ring, which acts against the inner wall of the spring cage 16. The triggering pin 91 acts by way of the peripheral projection 23 against the bottom seal 20 which for its part is supported on an inwardly projecting part of the bottom plate 6. The bottom-side end 14 of the triggering pin 91 projects through the central opening of the bottom plate 6 out of the pressurized can and can be correspondingly actuated from outside, for example by the triggering member 93.

Figure 4:
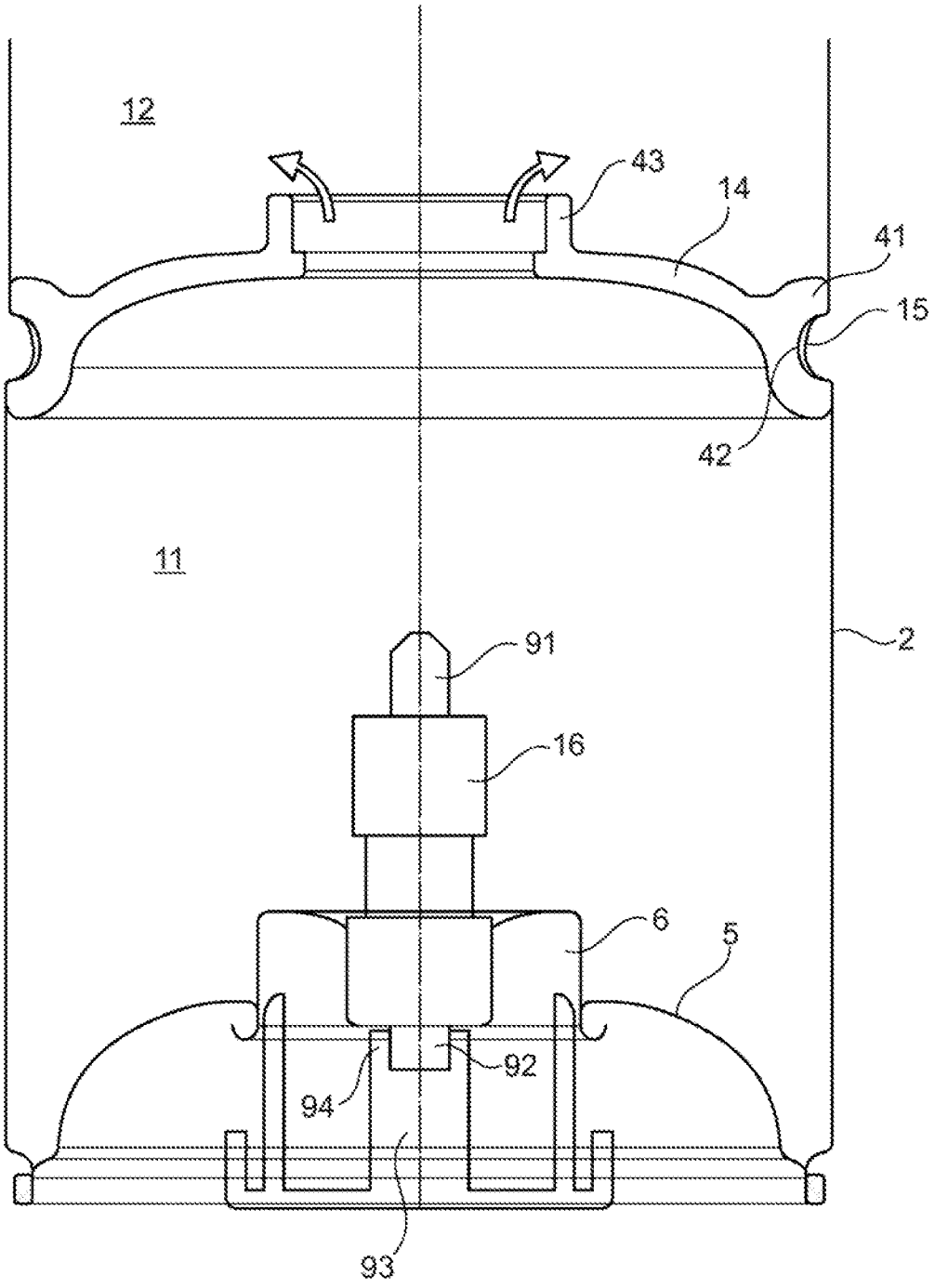
FIG. 4 shows the lower part of the pressurized can according to the invention from FIG. 2.

FIG. 4 shows the lower part of the pressurized can according to the invention from FIG. 2 after the closure element 8 has been ejected. The plunger 9 and cover 8 have been omitted in the illustration, the arrows designating the outlet direction of the second component contained in the lower chamber 11. The lower chamber 11 is expediently filled pressurelessly with the second component to an extent of approximately 60 to 100%. This results in the fact that, after the cover has been ejected, on the one hand, gas—as a rule, air—contained in the lower chamber 11 rises into the upper chamber 12 and, on the other hand, liquid flows out of the upper chamber 12 into the lower chamber 11, also driven by the higher pressure prevailing there. This promotes the mixing of the two components. In addition, mixing-promoting elements can be present, for example balls or rods made of metal. The cover 8 released from its anchoring and also the plunger 9, neither being illustrated here, can move freely in the can space and contribute to the mixing of the two components upon shaking of the can.

FIG. 4 shows the triggering pin 91 in its triggering position (plunger 9 not shown), that is to say it has been pressed out of the spring cage 16, by contrast with the illustration in FIG. 2. The triggering knob 93 has been is correspondingly pushed into the can bottom and impinges against the bottom plate 6 by the upper edge of its receptacle 94. The bottom plate 6 limits the insertion of the triggering member 93 into the bottom region of the pressurized can.

Figure 5:
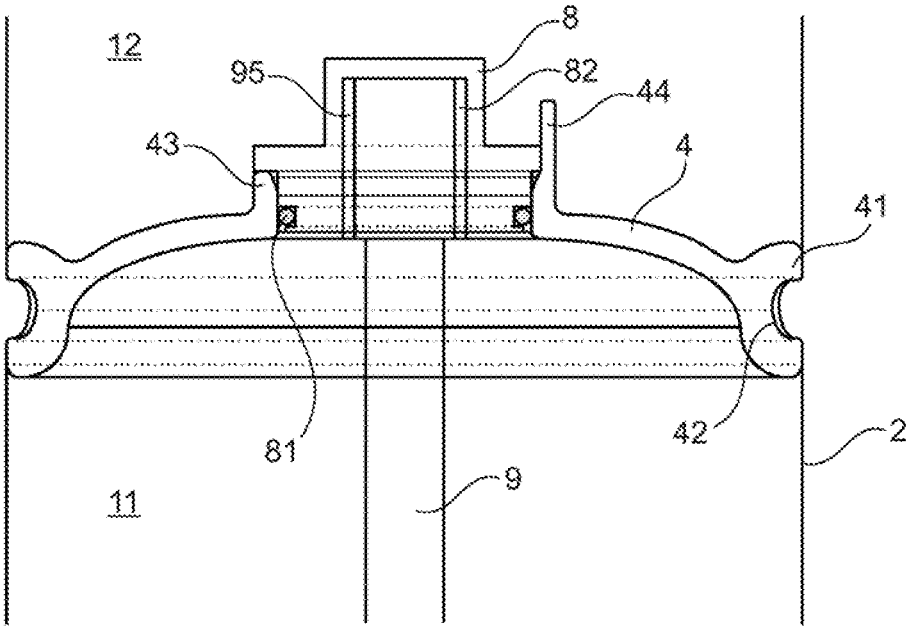
FIG. 5 shows a second variant of an opening device according to the invention with closure element.

FIG. 5 shows a second variant of an opening device according to the invention in the region of the separating disk 4. In this case, the opening device has a threaded rod 9 which is guided through the bottom into the lower chamber 11 and is screwed completely by its threaded part 95 into the receptacle 82 of the cover 8. The receptacle 82 is correspondingly provided with an internal thread.

The threaded rod 9 is rotatably mounted within a receptacle which corresponds to the spring cage 16 of FIG. 2, but is fixed in its position. Sealing elements are provided in order to secure the sealing tightness to the outside.

Rotating the threaded rod 9 by means of a handle or a transverse rod outside the can causes it to be rotated out of the receptacle 82 of the cover 8. Since the threaded rod 9 cannot change in its position itself, this leads to the cover 8 being detached from the separating disk 4.

To ensure that the cover 8 cannot corotate with the threaded rod, the separating disk 4 has, in the region of the edge 43, a nose 44 which interacts with a corresponding notch of the cover 8 in the edge region. This prevents the cover 8 from corotating upon rotation of the threaded rod 9, with the result that the rotational movement of the threaded rod 9 is converted into an upward movement of the cover 8, which is released from its anchoring in the separating disk 4 and frees the opening into the upper chamber 12.

It goes without saying that, apart from the forms of the cover that are illustrated here, numerous further variants are possible for the closure element, for example in the form of a membrane which is stretched over the opening of the separating disk 4 and which is secured in its position by a securing ring, in the form of a separating disk which is clamped into the opening and which is pressed out of its anchoring by the pressure of the plunger, or in the form of a thin plastic plate which is integrally formed with the separating disk 4 in the region of the opening and which is ejected by the plunger or is torn open along an annular weakening zone.

Equally, the spring cage 16 can be replaced by a rubber plug, as described for example in WO 85/00157 A mentioned above.

Figure 6:
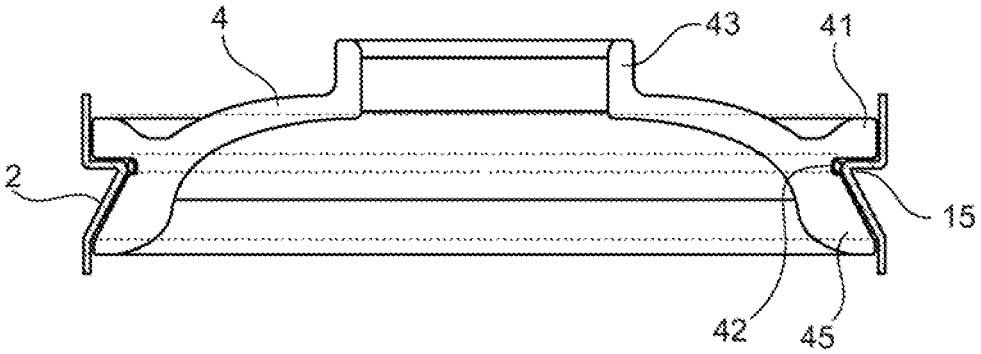
FIG. 6 shows a variant of the separating disk according to the invention.

FIG. 6 shows a variant of the separating disk 4 according to the invention with the collar 43 for securing the plug (not shown). The edge region of the separating disk 4 is of asymmetrical design with a smaller upper branch 41 and a larger, reinforced lower branch 45 which improves the load transfer. The two branches 41 and 45 flank the peripheral groove 42 in which the necking 15 of the can body 2 engages.

The necking 15 is step-shaped in form such that it forms a bearing surface pointing in the direction of the upper chamber. In this region, the necking extends substantially perpendicularly to the can axis. The underside of the upper branch 41 of the edge region of the separating disk 4 is adapted to the step-shaped profile of the necking 15, as is the lower branch 45 with its contact side to the necking 15. This improves the seating of the separating disk, which can be beneficial particularly in the case of relatively large pressure differences between the chambers.

In principle, it may be expedient to stabilize the necking, irrespective of what shape it has, by a ring applied on the outside in order to counteract the internal pressure of the pressurized can. Such a ring inserted into the necking can consist of rubber, plastic or metal.

It goes without saying that the embodiments shown in the drawings can be combined in any desired manner where this is technically expedient.

The invention claimed is:

1. A two-component pressurized can having a body, a dome, a valve arranged in the dome, an inwardly curved bottom, and an opening device which is arranged in the bottom and can be actuated from the outside, wherein the can body has a peripheral necking to which there is secured a separating disk which divides the can into a lower chamber and an upper chamber, the separating disk has a central opening which is closed by a closure element, and the opening device can be moved against the closure element via a triggering member in order to detach the closure element from the separating disk.

2. The pressurized can as claimed in claim 1, wherein the separating disk is curved into the upper chamber.

3. The pressurized can as claimed in claim 1, wherein the separating disk has a collar which delimits the central opening.

4. The pressurized can as claimed in claim 1, wherein the central opening is circular in form.

5. The pressurized can as claimed in claim 1, wherein the separating disk has a peripherally extending groove which interacts with the necking.

6. The pressurized can as claimed claim 1, wherein the separating disk consists of a pressure-resistant plastic.

7. The pressurized can as claimed in claim 1, wherein the closure element takes the form of a membrane, plug, or cover and is applied in the upper space to the central opening.

8. The pressurized can as claimed in claim 7, wherein the membrane is adhesively bonded or welded to the separating disk or else is integrally formed with the separating disk.

9. The pressurized can as claimed in claim 8, wherein the membrane is integrally formed with the separating disk and has predetermined breaking points.

10. The pressurized can as claimed in claim 7, wherein the plug is fitted sealingly into the central opening.

11. The pressurized can as claimed in claim 10, wherein, for sealing purposes, the plug has a peripheral O-ring.

12. The pressurized can as claimed in claim 1, wherein the opening device has a plunger which, upon triggering of the opening device, acts against the closure element.

13. The pressurized can as claimed in claim 12, wherein the opening device has a triggering pin which is resiliently mounted in a spring cage arranged centrally in the bottom, can be actuated by the triggering member, and is suitable for displacing the plunger vertically against the closure element.

14. The pressurized can as claimed in claim 1, wherein the opening device has a screw rod which is mounted in a thread and extends through the inwardly curved bottom.

15. The pressurized can as claimed in claim 14, wherein a threaded block is arranged in the bottom of the pressurized can.

16. The pressurized can as claimed in claim 14, wherein the closure element has a threaded block into which the threaded rod is screwed such that, upon actuation of the threaded rod, the closure element is separated from the central opening of the separating disk.

17. The pressurized can as claimed in claim 16, wherein the closure element is a plug which is prevented from rotating in the central opening by an arresting means.

* * * * *